US006338238B1

(12) United States Patent
Kahan

(10) Patent No.: US 6,338,238 B1
(45) Date of Patent: Jan. 15, 2002

(54) COIL LINK CHAIN AND METHOD

(75) Inventor: Marvin Kahan, Brooklyn, NY (US)

(73) Assignee: Charm Link, Inc., New York, NY (US)

( * ) Notice: Subject to any disclaimer, the term of this patent is extended or adjusted under 35 U.S.C. 154(b) by 0 days.

(21) Appl. No.: 09/492,514

(22) Filed: Jan. 27, 2000

(51) Int. Cl.[7] ..... B21L 5/02; F16G 13/00
(52) U.S. Cl. ..... 59/80; 59/35.1; D11/13
(58) Field of Search ..... 59/80, 35.1; D11/13

(56) References Cited

U.S. PATENT DOCUMENTS

| | | | | | |
|---|---|---|---|---|---|
| 407,723 | A | * | 7/1889 | Crook | 59/80 |
| 979,110 | A | * | 12/1910 | Ungerer | 59/80 |
| 1,280,087 | A | * | 9/1918 | Reitz | 59/80 |
| 4,493,183 | A | * | 1/1985 | Bucefari et al. | 59/80 |
| 4,651,517 | A | | 3/1987 | Benhamou et al. | 59/80 |
| 4,934,135 | A | * | 6/1990 | Rozenwasser | 59/80 |
| 5,285,625 | A | * | 2/1994 | Ofrat et al. | 59/80 |
| 5,303,540 | A | * | 4/1994 | Rozenwasser | 59/80 |
| 5,487,264 | A | * | 1/1996 | Strobel | 59/80 |
| 5,605,038 | A | | 2/1997 | Rozenwasser | 59/80 |
| D383,695 | S | * | 9/1997 | Rozenwasser | D11/13 |
| D385,210 | S | * | 10/1997 | Rozenwasser | D11/13 |
| 5,737,910 | A | | 4/1998 | Rozenwasser | 59/80 |
| D394,224 | S | * | 5/1998 | Rozenwasser | D11/13 |
| D395,022 | S | * | 6/1998 | Rozenwasser | D11/13 |
| D406,245 | S | * | 3/1999 | Rozenwasser | D11/13 |
| 5,911,677 | A | * | 6/1999 | Kupelian | 59/80 |

* cited by examiner

*Primary Examiner*—David Jones
(74) *Attorney, Agent, or Firm*—Helfgott & Karas, PC.

(57) ABSTRACT

A jewelry chain is formed from a plurality of coil links, with each link having a coil diameter, a first end and a second end. With the exception of the ends of the chain, which are typically secured to the mating clasp sections, each of the links in at least a portion of the body section are intertwined with two or more links. The number of coils capable of being intertwined is predominantly governed by the coil diameter and the number of turns in each coil.

36 Claims, 7 Drawing Sheets

COIL LINK CHAIN AND METHOD

FIELD OF THE INVENTION

This invention relates generally to a chain formed from coil links, and more specifically to a chain where the links are uniquely intertwined to form a unique configuration.

BACKGROUND OF THE INVENTION

Jewelry chains are usually formed from separate links that are intertwined or interengaged in some fashion to produce an aesthetically appealing article. Chain links come in all shapes, sizes, cross-sections and configurations, depending on the desired final product and the method of making the same. For example, so-called rope chains are commonly created by intertwining solid or hollow links of an annular, toroidal configuration via gaps in such links. The appearance of such rope chain may be further enhanced by polishing, faceting or the like. The methods in which individual links are intertwined via gaps in such links to ultimately form a helical rope-like structure are covered in numerous patent documents, including U.S. Pat. No. 4,651,517 to Benhamou et al. and others.

The links that form the chain of the instant invention are formed from spiral-shaped coils. Typical coil chains are made of turns of spirals that are interconnected one to another. U.S. Pat. No. 5,605,038 to Rozenwasser shows one such typical coil chain. In the '038 patent, each coil is preferably formed from less than two complete turns, or X+Y turns where X is an integer and Y is preferably a fraction about ¾. The manner in which Rozenwasser solders his coils together dictates the use of incomplete turns. Also, each coil is attached to one adjacent coil, and thus aside from the end coils, each coil is interconnected with one preceding coil and one following coil. This type of chain is commonly referred to as a so-called "Garibaldi" chain.

The present invention comprises a different way of forming a coil link chain so that after it is assembled, it gives the appearance of a simulated rope chain, although it is not formed in the manner of a rope chain but actually comprises coils. The coil chain of the present invention differs from that taught by the prior art, typified by the Rozenwasser '038 patent, in two critical aspects. First, the chain of the present invention is preferably formed from coil links having nearly complete, or integer-based turns, where the number of turns in each coil is preferably approximately 1–5. Second, the chain of the present invention is formed from links that are each connected to multiple adjacent links, i.e., where one coil is connected on at least one side to at least two intertwined coils. The increased number of interconnected coils results in a chain having a helically intertwined configuration with increased interconnected and intertwined surfaces. Thus, a coil link chain formed in accordance with the teachings of the present invention gives the appearance of a simulated rope chain, even though the assembly differs quite dramatically from a typical rope chain.

OBJECTS OF THE INVENTION

It is an object of the present invention, therefore, to provide a jewelry chain formed from coil links, where such links are formed from complete, or approximate integer turns. It is a further object of the present invention to provide a coil link jewelry chain where each link in the main body section is adjacently connected to more than one link on each side thereof.

It is a still further object of the present invention to provide a coil link jewelry chain that gives the appearance of a simulated rope chain even though it is not a rope chain as conventionally defined in the art.

Still other objects and advantages of the invention will become clear upon review of the following detailed description in conjunction with the appended drawings.

SUMMARY OF THE INVENTION

A jewelry chain is formed from a plurality of coil links, with each link having a coil diameter, a first end and a second end and having X number of turns, where X is preferably approximately an integer from approximately 1–5. With the exception of the ends of the chain, which are typically secured to the mating clasp sections, each of the links are intertwined with Y number of preceding links and Y number of following links, where Y is an integer preferably from 2 to 6. This method of adjacently intertwining multiple coil links creates the appearance of a simulated rope chain, even though the chain is formed from coils, and is therefore lightweight with a full-bodied appearance. The number of coils capable of being adjacently interconnected is governed by the coil diameter and the number of turns in each coil.

DETAILED DESCRIPTION OF THE PREFERRED EMBODIMENTS

Figure 1:
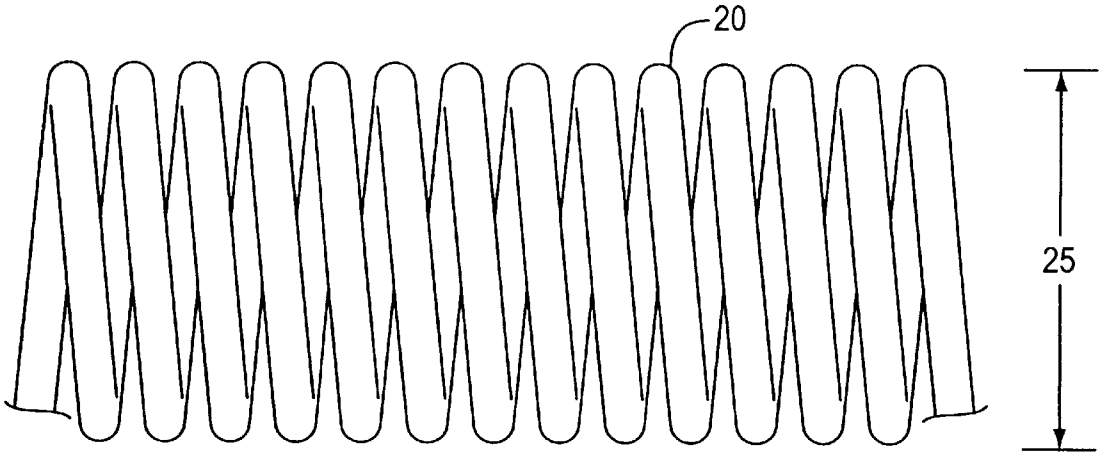
FIG. 1 is a front view of a coil from which the coil links of the invention will be segmented.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 is a front view of a coil 20, which is cut or segmented in strategic locations to form the spiral-shaped links that will be intertwined to form a chain of the present invention. Such coil has a diameter 25, which also forms the diameter of each of the chain links cut therefrom.

FIGS. 2A through 2E illustrate pairs of intertwined links 30–39 that have been segmented from the coil 20 of FIG. 1, each coil having a diameter 25 as discussed above. Each intertwined pair of coils is formed from X number of approximate integer-based turns, where X preferably ranges from a value of 1 as shown in the coils 30,31 of FIG. 2A, to a value of 5 as shown in the coils 38,39 of FIG. 2E. Other X values greater than 5 may be used. Practically speaking, the number of turns should start at 2 so that the link resembles a coil and not a conventional, annular link as is known in the rope chain art. Such coils may also be of a hollow configuration, as shown in the coils 30,31 of FIG. 2A, or of a solid configuration, as shown in some of the other figures. Also, while the coil links shown in FIGS. 2A through 2E have an annular cross-section, it will be understood that coils having any cross-sectional shape may be used to achieve a chain with a desired appearance.

Figure 5:
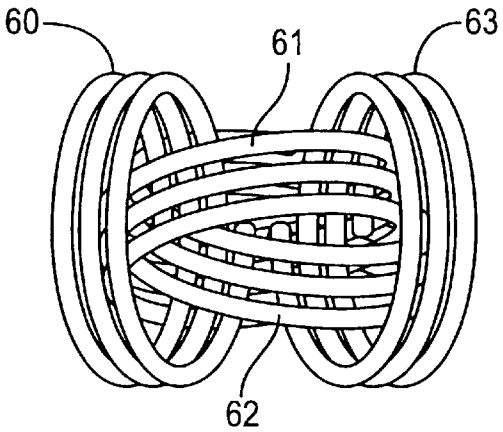
FIG. 5 represents a sample grouping.

As noted above, the coil links of the prior art Rozenwasser '038 patent are arranged by interconnecting one coil with another (see, in particular, FIGS. 1, 2 and 5 of the '038). On a very elementary level, this is illustrated with the intertwining of two coils as shown in FIGS. 2A through 2E, where a complete chain would be formed from the adjacent intertwining of a single coil with another single coil on either side. The coil links of the present invention are joined one-by-one to form a chain as shown in the '038 patent, but instead are grouped by the adjacent intertwining of multiples of coil links.

Figure 3:
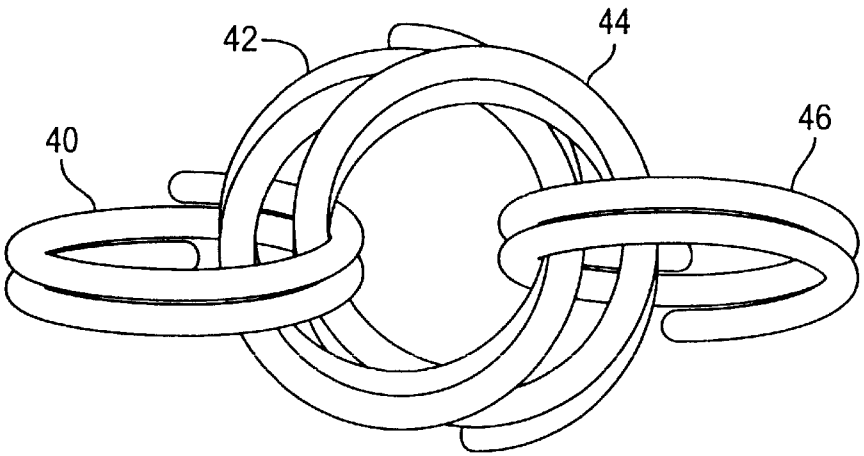
FIG. 3 is a grouping of two-turn coils, where the middle coil links are each intertwined with two preceding and two following coil links.

FIG. 3 illustrates the beginning of the formation of a coil chain of the present invention, with four representative links 40, 42, 44 and 46 shown to illustrate the unique intertwining method of the invention. Link 40, which might represent the end of a chain formed in accordance with the method of the invention, is connected to links 42 and 44 that follow, or come after, link 40 in the chain. Thus, link 40 is connected to two following links. Similarly, link 42 is connected to links 44 and 46 that follow or come after link 42. The same holds true for the number of links that precede, or come before. For example, starting from the right in FIG. 3, link 46, which might represent the end of a chain formed in accordance with the method of the invention, is intertwined with two preceding links 44 and 42. Similarly, link 44 is intertwined with two preceding links 42 and 40. An expanded grouping showing the method of intertwining is shown in FIG. 4A, while a section of a chain showing the unique groupings is shown in FIG. 4B.

Figure 4A:
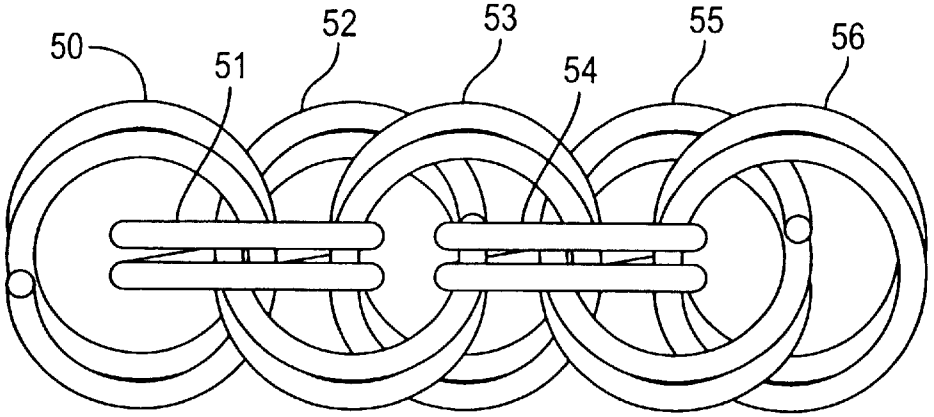
FIGS. 4A and 4B illustrate expanded sections of a chain of the invention formed from two-turn coil links, where each coil link is intertwined with two preceding and two following coil links.
Figure 4B:
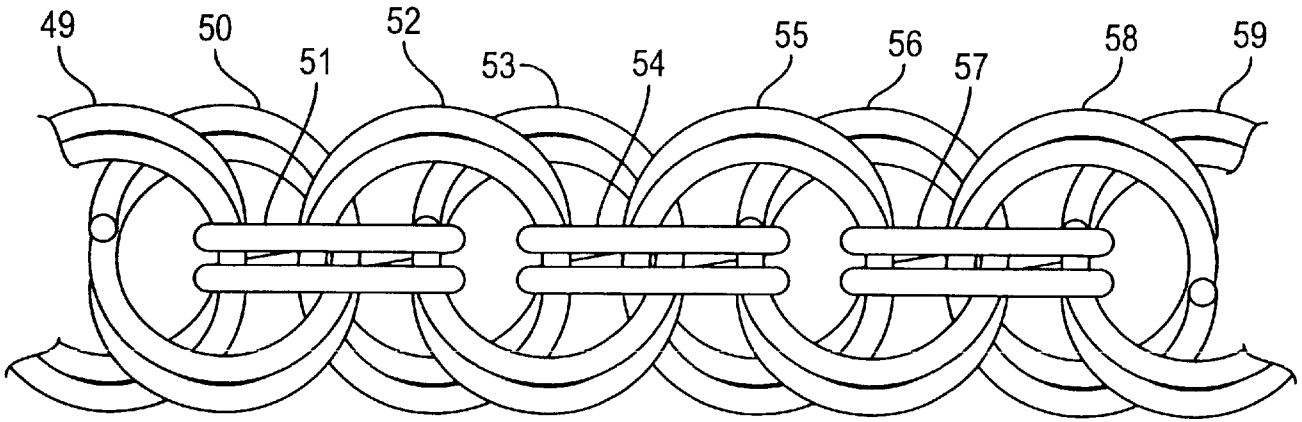

In FIGS. 4A and 4B, each coil link having two substantially complete turns is intertwined with two preceding links and two following links. For example, link 52 is intertwined with two preceding links 50, 51 and two following links 53, 54. Similarly, link 53 is intertwined with two preceding links 51,52 and two following links 54,55. Similarly again, link 54 is intertwined with two preceding links 52,53 and two following links 55,56. And so on. It will be understood that the links 49–59 of FIG. 4B comprise a portion of the body section of a chain formed in accordance with the intertwining method of the present invention, while the links 50 and 56 of FIG. 4A in particular might represent the end links that form the end sections typically attached to mating clasp sections. Furthermore, in FIGS. 3 through 4B, it should be noted that the number of turns comprising the coil links, here two, is equal to the number of intertwined links that precede and follow each link. The number of turns does not have to equal the number of intertwined preceding and following links, as will be described below.

Figure 6:
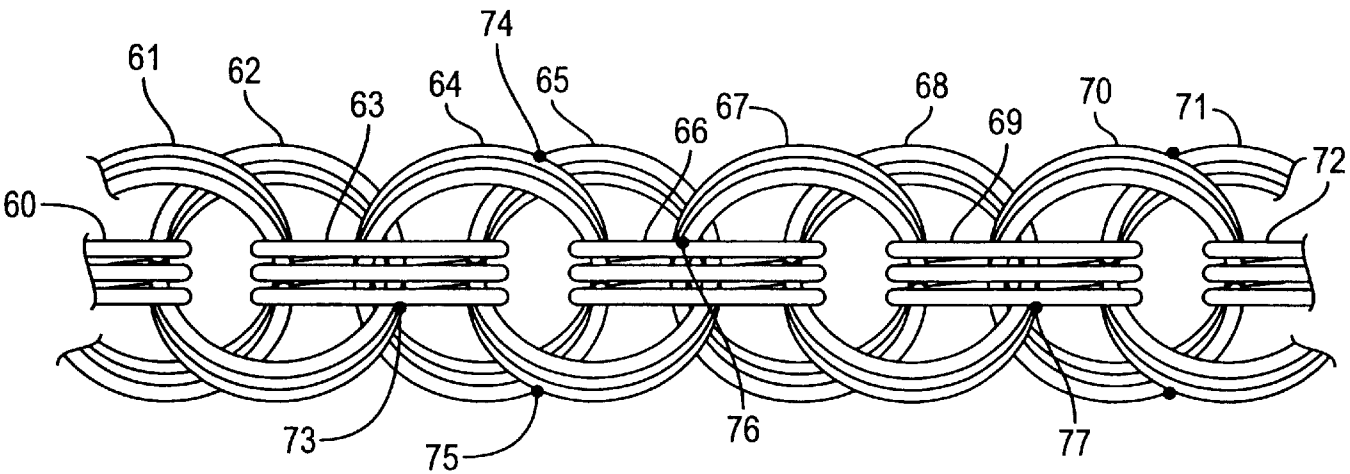
FIG. 6 represents the body section of a chain formed from three-turn coil links, where each link is intertwined with two preceding links and two following links.

FIG. 5 represents a sample grouping and FIG. 6 represents a portion of the body section of a chain formed from coil links 60–72 each having three substantially complete turns, with each link being intertwined with two preceding links and two following links. In FIG. 6, for example, link 62 is intertwined with two preceding links 60,61 and two following links 63,64, while link 66, for example, is intertwined with two preceding links 64,65 and two following links 67,68. Thus, the intertwining illustrated in FIGS. 5 and 6 demonstrates that the number of turns can be greater than the number of preceding and following links with which each individual link is intertwined. Of course, other variations are possible. Practically speaking, a chain formed in accordance with the methods of the present invention would be formed from links have X turns, where X is an integer preferably between 1–5, with such links between intertwined with Y number of preceding and following links, where Y is an integer preferably between 2–6. Again, other X and Y values outside these preferred values may be used.

FIG. 6 also illustrates examples of solder locations 73–77, which are near the ends of the coil links as shown. It is preferable to have pairs of adjacently positioned coils connected or soldered in two places near the ends of the coil links to form a soldered pair, and it is also preferable to have the individual soldered pairs not soldered to each other. For example, links 62 and 63 are soldered together at two locations, only one of which, i.e., location 73, is viewable in FIG. 6, to form a soldered pair. Links 64 and 65 are soldered at locations 74 and 75 near their respective coil ends to form another soldered pair. However, the soldered pairs of links 62,63 and 64,65 are not soldered together. Similarly, links 66 and 67 are soldered at location 76 near the coil ends and at another location near the other ends of such coils not viewable in FIG. 6 to form yet another soldered pair. Links 68 and 69 are soldered at location 77 near their coil ends and at another location near the other ends of such coils not viewable in FIG. 6 to form a further soldered pair. Links 70 and 71 are soldered at two locations as shown. But the soldered pairs of links 66,67 and 68,69 are not soldered to each other, nor are the pairs 68,69 and 70,71. Because of this method of soldering, i.e., near the ends and not across the coil body itself, there is still flexibility in the coil link, and thus in the chain itself. This flexibility is enhanced in the coil link chain of the invention because, due to the outside, accessible soldering locations, a majority of each coil link remains unsoldered, and is therefore able to flex as desired.

Figure 7A:
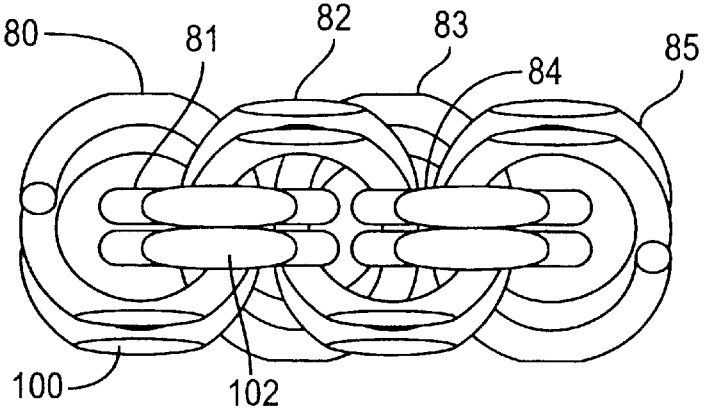
FIGS. 7A and 7B illustrate faceted sections of a chain of the invention formed from two-turn coil links, where each link is intertwined with two preceding and two following links.
Figure 7B:
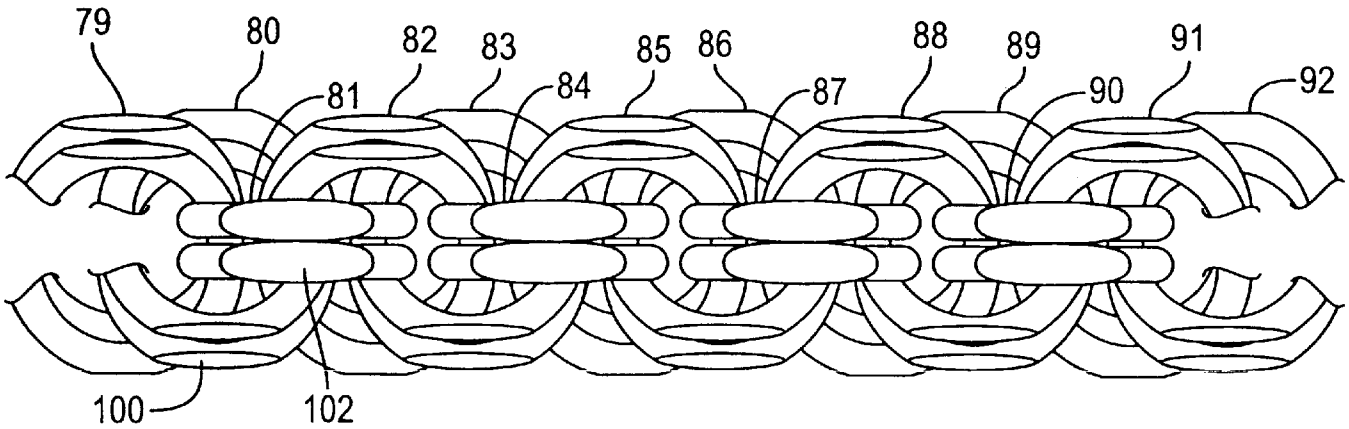

FIGS. 7A and 7B illustrate sections of a chain formed from faceted links 79–92 intertwined in accordance with the method of the present invention. The coil links of FIGS. 7A and 7B are intertwined in the same manner as the coil links of FIGS. 4A and 4B, i.e., with each coil link comprised of two substantially complete turns and each link being intertwined with two preceding links and two following links. The facets, represented in part by reference numerals 100 and 102, may be applied to the links by any manner known in the art. For example, the chain might be faceted using the well-known ice lathe method, or it might be faceted using other dry methods known in the art. Furthermore, such links might be individually pre-faceted prior to assembly into a chain, or the links might be subject to faceting after assembly.

Figure 8A:
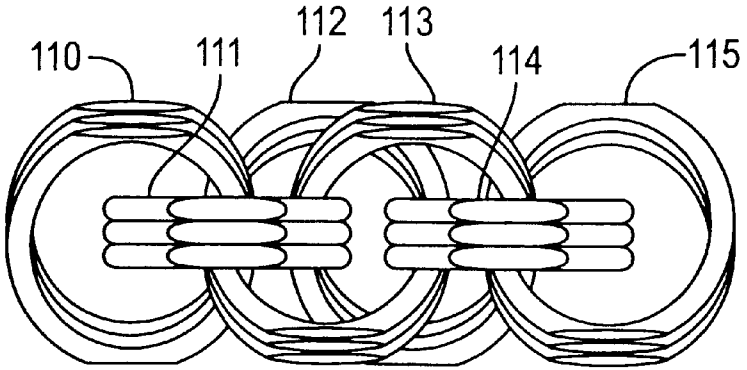
FIGS. 8A and 8B illustrate faceted sections of a chain of the invention formed from three-turn coil links, where each link is intertwined with two preceding and two following links.
Figure 8B:
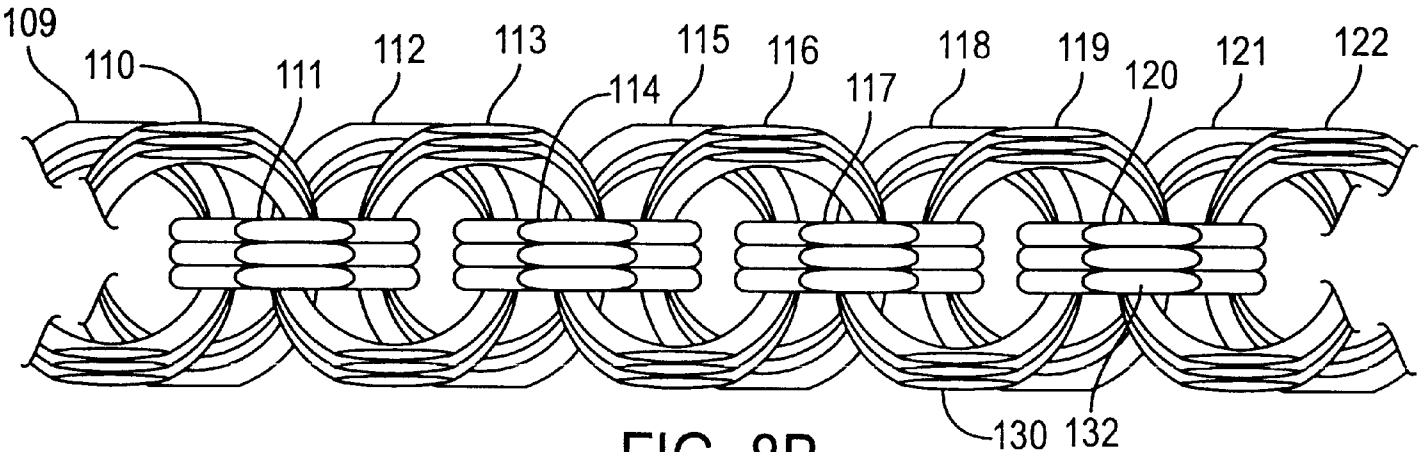

FIGS. 8A and 8B illustrate sections of a chain having faceted links 109–122 intertwined in accordance with the method of the present invention. The coil links of FIGS. 8A and 8B are intertwined in the same manner as the coil links of FIGS. 5 and 6, i.e., with each coil link comprised of three substantially complete turns and each link being intertwined with two preceding links and two following links. The facets, represented in part by reference numerals 130 and 132, may be applied to the links by any manner known in the art as discussed above. While such chain sections are shown faceted, it will be understood that such chains could also be un-faceted in accordance with the wishes of the ultimate purchaser.

Figure 2A:
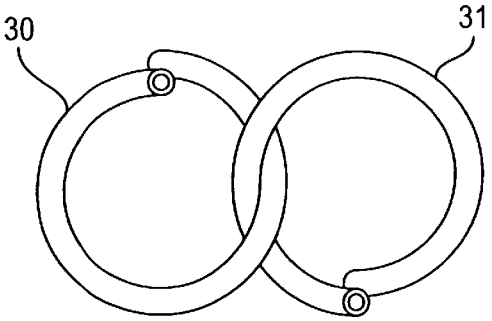
FIGS. 2A through 2E illustrate pairs of intertwined coil links, where each coil comprises X number of turns, where X=1–5.
Figure 2B:
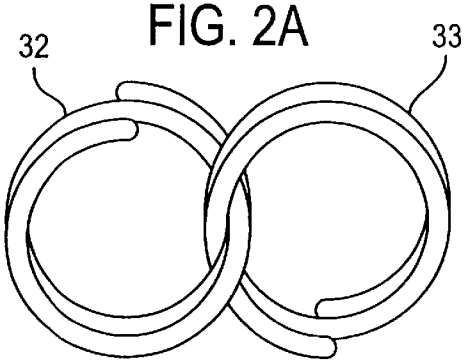
Figure 2C:
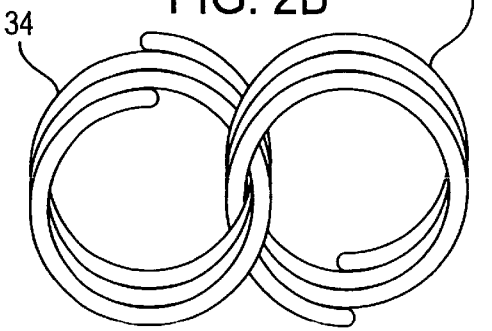
Figure 2D:
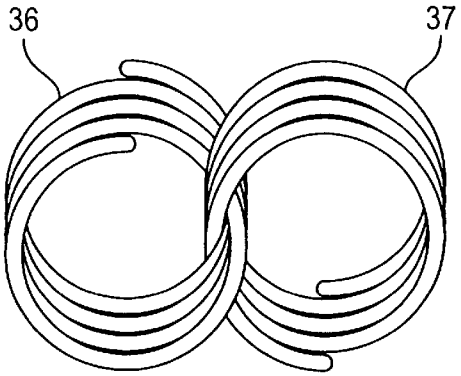
Figure 2E:
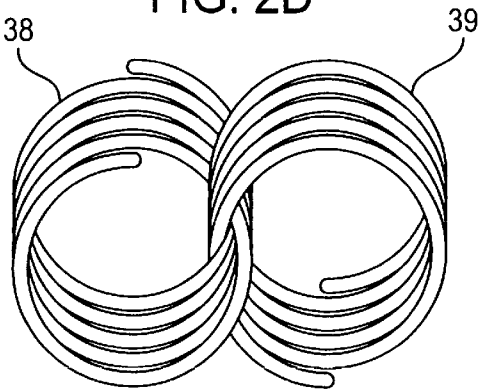

It will be understood, with reference to FIGS. 7A through 8B, that one must use a greater coil diameter to accommodate the intertwining of coils having increased numbers of turns and where the number of intertwined links is also increased relative to the number of turns. In other words, to create the chains of FIGS. 8A and 8B, each three-turn link will have to accommodate two other three-turn links within the centers of such links. Thus, if one were intertwining four-turn links, as shown in FIG. 2D, with three preceding and following links, the coil diameter from which such links are formed would have to be large enough so that each link could effectively accommodate twelve turns worth of links therein. This concept should be self-evident with reference to the partial chain sections shown in the appended drawings.

Figure 9A:
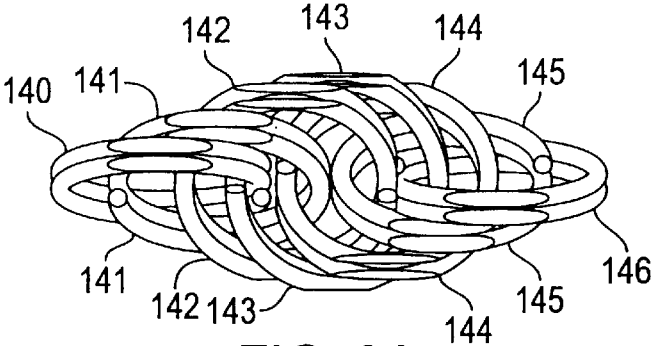
FIGS. 9A and 9B illustrate faceted sections of a chain of the invention formed from two-turn coil links, where each link is intertwined with three preceding and three following links.
Figure 9B:
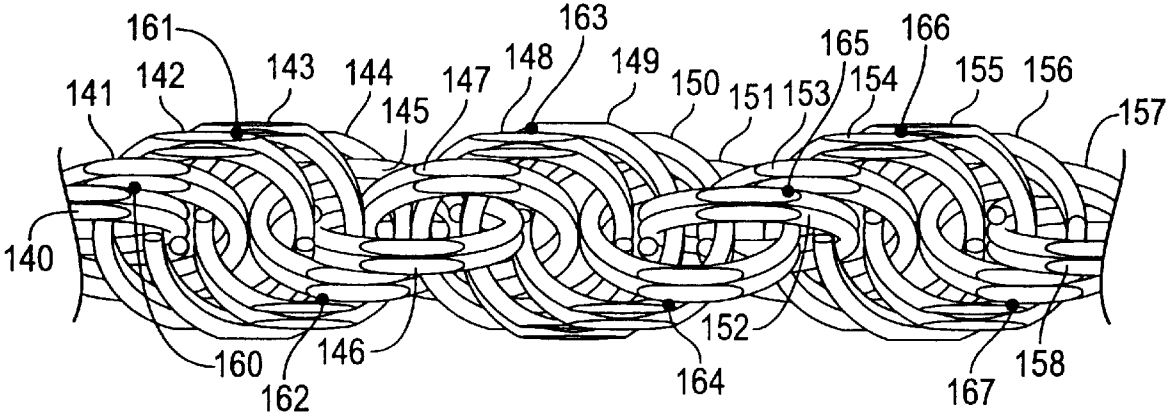

FIGS. 9A and 9B illustrate faceted chain sections formed from two-turn coil links 140–158, where each link is intertwined with three preceding and three following links. For example, coil link 143 is intertwined with three preceding links 140–142 and three following links 144–146. Thus, the number of turns in each coil link may be less than the number of preceding and following links with which each link is intertwined. This is different from the chain sections shown in FIGS. 5 and 6, where the number of turns in each coil link was greater than the number of preceding and following links with which each link is intertwined, and different from the chain sections shown in FIGS. 4A and 4B, where the number of turns in each coil link was equal to the number of preceding and following links with which each link is intertwined. Again, while such chain sections are shown faceted, it will be understood that such chains could also be un-faceted in accordance with the wishes of the ultimate purchaser.

In FIG. 9A, for example, coil link 140 might represent a link from an end section of a chain, i.e., the end sections being attached to mating clasp sections or the like, in which case such link 140 would only be intertwined with three following links 141–143. Similarly, coil link 146 might represent a link from another end section, in which case such link 146 would only be intertwined with three preceding links 143–145. Thus, it will be understood that the links forming the end sections of the chains would not be intertwined with both following and preceding links, but only one of the two.

Alternatively, the grouping of coils in FIG. 9A might represent one portion of the body section of a chain, where coil link 140 might be connected to a different number of preceding links than following links and coil link 146 might also be connected to a different number of following links than preceding links. For example, a chain formed in accordance with the prior art method of having coil links individually intertwined throughout the chain might have sections or portions of coil links that are intertwined in multiples in accordance with the method of the present invention. Thus, a chain may be formed from portions where each coil link is intertwined with only one link (prior art), and portions where each coil link is intertwined with more than one link (present invention). Furthermore, different portions of a single chain may be formed from coil links having different numbers of intertwined groupings, where, for example, one portion of a chain is formed from coil links that are intertwined with two preceding links and two following links as shown in FIG. 4A, while another portion of the chain might be formed from coil links that are intertwined with three preceding links and three following links as shown in FIG. 9A. Thus, a single chain can be formed with a variety of different groupings of intertwined coils along different portions of the chain, where at least one of such groupings is constructed in accordance with the present invention, i.e. formed from a coil that is intertwined with two or more coils.

As demonstrated by the chain section of FIG. 9B, it will be realized that as the number of intertwined groupings of links increases, the more the chain simulates the appearance of a conventional rope chain. The chain section of FIG. 9B is helical in appearance, yet each coil link is completely intertwined with adjacent coils, and not partially intertwined through gaps as with conventional rope chains. Thus, by constructing a chain in accordance with the method of the present invention, one can achieve the look of a rope chain having a unique construction of coil links, which coil links are both lightweight and springingly flexible. In addition, the use of coil links, as opposed to conventional annular links with a gap, results in a stronger chain construction, due to the plurality of turns forming each coil and the intertwining of such coils having such multiple turns. The chain appearance can be altered by modifying the number of turns in each link, and the number of preceding and following links with which each link is intertwined, with both values being determined or limited by the coil diameter 25 (see FIG. 1) from which the coil links are created.

FIG. 9B also illustrates solder locations 160–167, which connect link pairs 140–141, 142–143, 144–145, 148–149, 150–151, 152–153, 154–155 and 156–157 respectively. Links 146 and 147 are also soldered together, but such soldering is not shown due to the spaced apart illustration of such links. Each link pair is soldered in two locations, although only one location is generally viewable in FIG. 9B. Also, as previously discussed in connection with FIG. 6, each link pair is preferably not soldered to other links pairs, i.e., link pair 140–141 is not soldered to link pair 142–143, and so on. This method of soldering is also beneficial from a manufacturing viewpoint, since it allows the simulated rope chain of the invention to be intertwined in its entirety as a first step, and then soldered in its entirety as a second step. With conventional rope chain manufacture, the links must be soldered during the intertwining process, which adds considerable time to the manufacture of a the chain. The coil chain of the present invention, however, can be constructed or intertwined without having to solder during such construction, which soldering can be done at a later time if necessary or more convenient.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A jewelry chain having a body section, said chain comprising;

a) a plurality of intertwined chain links, each of said links formed from a coil having a coil diameter, a first end and a second end and having X turns, where X is approximately or equal to an integer having a value from 2–5, and b) wherein each of said links in said body section is intertwined with Y number of preceding links and Y number of following links, where Y is an integer having a value of at least 2.

2. A jewelry chain in accordance with claim 1, wherein Y is greater than X.

3. A jewelry chain in accordance with claim 1, wherein Y is less than X.

4. A jewelry chain in accordance with claim 1, wherein Y is equal to X.

5. A jewelry chain in accordance with claim 1, wherein said chain is faceted.

6. A jewelry chain in accordance with claim 1, wherein said plurality of links are intertwined in a helical configuration to form a simulated jewelry rope chain.

7. A jewelry chain in accordance with claim 1, wherein said links are of a solid configuration.

8. A jewelry chain in accordance with claim 1, wherein said links are of a hollow configuration.

9. A jewelry chain in accordance with claim 1, wherein said chain further comprises a pair of end sections and said links in said end sections of said chain are intertwined with either Y number of preceding links or Y number of following links.

10. A jewelry chain in accordance with claim 1, wherein adjacently positioned coils are soldered in pairs near their respective first and second coil ends.

11. A jewelry chain in accordance with claim 10, wherein pairs of soldered coils are not soldered to each other.

12. A jewelry chain in accordance with claim 1, wherein the values of X and Y are limited by the coil diameter.

13. A method of making a jewelry chain having a body section, said method comprising the steps of:

a) providing a plurality of chain links, each of said links formed from a coil having a coil diameter, a first end and a second end and having X turns, where X is approximately or equal to an integer having a value from 2–5, and b) in said body section, intertwining said chain links with Y number of preceding links and Y number of following links, where Y is an integer having a value of at least 2.

14. A method of making a jewelry chain in accordance with claim 13, wherein Y is greater than X.

15. A method of making a jewelry chain in accordance with claim 13, wherein Y is less than X.

16. A method of making a jewelry chain in accordance with claim 13, wherein Y is equal to X.

17. A method of making a jewelry chain in accordance with claim 13, further comprising the step of faceting said chain.

18. A method of making a jewelry chain in accordance with claim 13, wherein said plurality of links are intertwined in a helical configuration to form a simulated jewelry rope chain.

19. A method of making a jewelry chain in accordance with claim 13, wherein said links are of a solid configuration.

20. A method of making a jewelry chain in accordance with claim 13, wherein said links are of a hollow configuration.

21. A method of making a jewelry chain in accordance with claim 13, wherein said chain further comprises a pair of end sections and said links in said end sections of said chain are intertwined with either Y number of preceding links or Y number of following links.

22. A method of making a jewelry chain in accordance with claim 13, further comprising the step of soldering adjacently positioned coils in pairs near their respective first and second coil ends.

23. A method of making a jewelry chain in accordance with claim 22, wherein said pairs of soldered coils are not soldered to each other.

24. A method of making a jewelry chain in accordance with claim 13, wherein the values of X and Y are limited by the coil diameter.

25. A jewelry chain comprising:

a) a plurality of intertwined coil links, b) wherein at least one of said coil links is intertwined with two or more of said coil links, and c) wherein each coil link of said plurality has at least two turns, and d) wherein said at least one of said coil links is intertwined with X number of preceding links and Y number of following links and wherein one of X or Y has a value of at least two.

26. A jewelry chain in accordance with claim 25, wherein X and Y each have a value of two.

27. A jewelry chain in accordance with claim 25, wherein X is equal to Y.

28. A jewelry chain in accordance with claim 25, wherein X is greater than Y.

29. A jewelry chain in accordance with claim 25, wherein X is less than Y.

30. A method of making a jewelry chain comprising the steps of:

a) providing a plurality of coil links, and b) intertwining said coil links to form a chain, c) wherein at least one of said coil links is intertwined with two or more of said coil links, and d) wherein said each coil link of said plurality has at least two turns, and e) wherein at least one of said coil links is intertwined with X number of preceding links and Y number of following links and wherein one of X or Y has a value of at least two.

31. A method of making a jewelry chain in accordance with claim 30, wherein X and Y each have a value of two.

32. A method of making a jewelry chain in accordance with claim 30, wherein X is equal to Y.

33. A method of making a jewelry chain in accordance with claim 30, wherein X is greater than Y.

34. A method of making a jewelry chain in accordance with claim 30, wherein X is less than Y.

35. A method of making a jewelry chain in accordance with claim 30, further comprising the step of soldering adjacently positioned coils in pairs.

36. A method of making a jewelry chain in accordance with claim 35, wherein said pairs of soldered coils are not soldered to each other.

* * * * *